US005899045A

United States Patent [19]

Giannarelli

[11] Patent Number: 5,899,045

[45] Date of Patent: May 4, 1999

[54] MAUSOLEUM

[76] Inventor: Emilio Teodoro Giannarelli, 246 Nicholson Street, Fitzroy, Victoria, Australia, 3065

[21] Appl. No.: 08/881,127

[22] Filed: Jun. 24, 1997

[30] Foreign Application Priority Data

Jun. 24, 1996 [AU] Australia ..... PO0625

[51] Int. Cl.[6] ..... E04B 1/04

[52] U.S. Cl. ..... 52/745.01; 52/134; 52/137; 52/141; 52/742.14; 27/1; 27/35

[58] Field of Search ..... 52/135, 134, 136, 52/137, 140, 141, 79.9, 236.3, 236.9, 742.14, 745.01; 27/1, 35

[56] References Cited

U.S. PATENT DOCUMENTS

| | | | |
|---|---|---|---|
| Re. 29,532 | 2/1978 | Zwick | 52/140 |
| 692,067 | 1/1902 | Okey et al. . | |
| 2,783,523 | 3/1957 | Halley . | |
| 3,290,843 | 12/1966 | Werman . | |
| 3,439,461 | 4/1969 | Chandler et al. . | |
| 3,501,215 | 3/1970 | Gartner . | |
| 3,642,339 | 2/1972 | Ruderfer | 312/283 |
| 3,878,656 | 4/1975 | Duwe et al. | 52/134 |
| 3,897,663 | 8/1975 | Gaul | 52/136 |
| 3,905,167 | 9/1975 | Watkins et al. | 52/79 |
| 3,938,287 | 2/1976 | Gauchard | 52/134 |
| 3,938,773 | 2/1976 | Duwe et al. | 249/27 |
| 3,986,308 | 10/1976 | Jones | 52/134 |
| 4,048,772 | 9/1977 | Gaul | 52/136 |
| 4,068,425 | 1/1978 | Czorniak | 52/136 |
| 4,073,100 | 2/1978 | DiGiovanni, Jr. | 52/79.3 |
| 4,106,249 | 8/1978 | Morton | 52/336 |
| 4,288,952 | 9/1981 | Work | 52/138 |
| 4,304,080 | 12/1981 | Freeman | 52/309.9 |
| 4,989,382 | 2/1991 | Spronken | 52/252 |
| 5,115,607 | 5/1992 | Pirozzoli et al. | 52/134 |
| 5,134,758 | 8/1992 | Christensen | 27/35 |
| 5,243,794 | 9/1993 | Pikor | 52/136 |
| 5,261,199 | 11/1993 | Schmidt | 52/141 |
| 5,287,603 | 2/1994 | Schorman | 27/1 |
| 5,321,873 | 6/1994 | Goria | 27/35 |

FOREIGN PATENT DOCUMENTS

| | | |
|---|---|---|
| 2 507 658 | 6/1981 | France . |
| 84 09794 | 6/1984 | France . |
| WO 88/08912 | 11/1988 | WIPO . |

*Primary Examiner*—Christopher Kent
*Assistant Examiner*—Yvonne Horton-Richardson
*Attorney, Agent, or Firm*—Morrison & Foerster LLP

[57] ABSTRACT

A mausoleum (10) formed from a plurality of crypt structures (12) each having a generally tubular plastics crypt liners (14) surrounded at side, roof and floor portions thereof by set concrete (81).

24 Claims, 9 Drawing Sheets

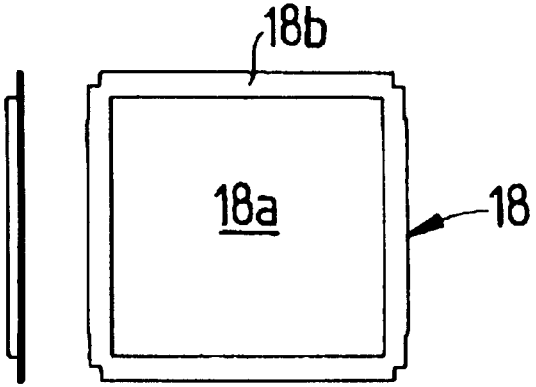
FIG 5
FIG 6
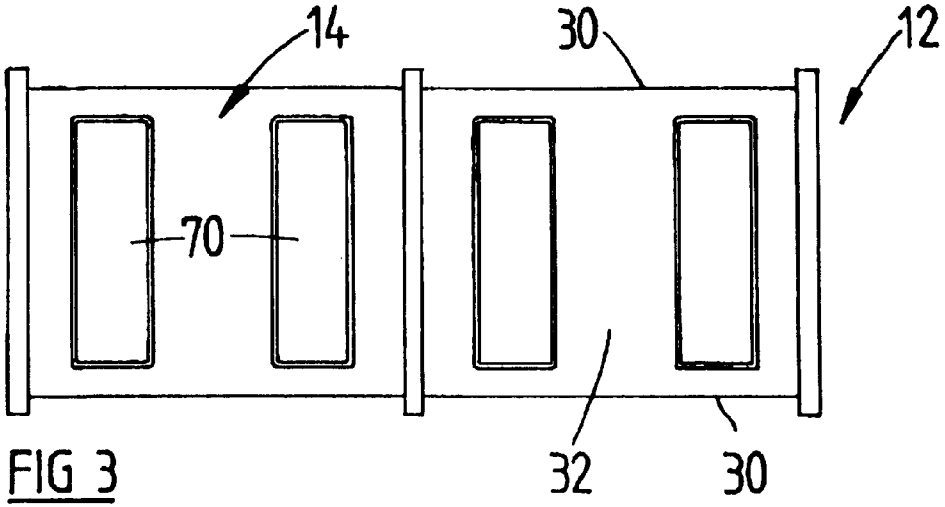
FIG 3
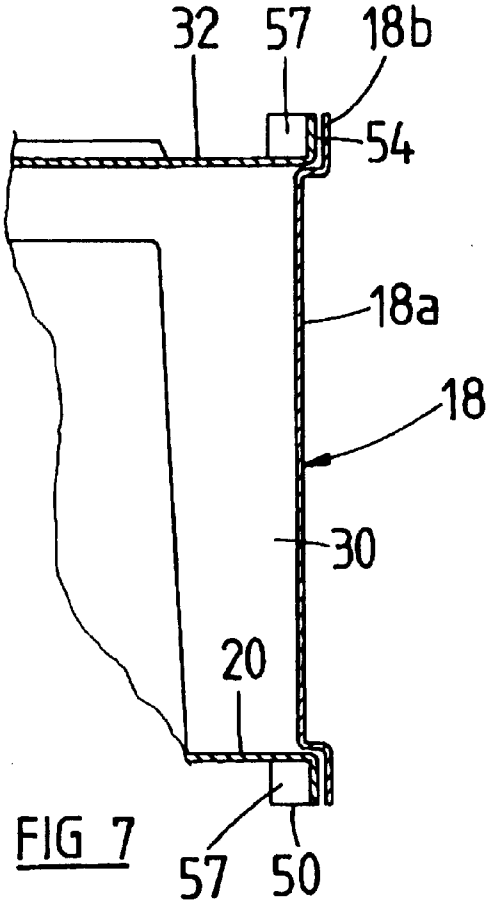
FIG 7

MAUSOLEUM

BACKGROUND OF THE INVENTION

1. Field of the Invention

This invention relates to a mausoleum and to a module for forming a mausoleum.

2. Prior Art

U.S. Pat. Nos. 3,878,656 (Duwe & Duwe), 3,897,663, 3,938,773, 4,048,772, 4,068,425, 5,243,794 describe various forms of mausoleums constructed from prefabricated members. These are intended for above ground burial and, usually, present a vertically and horizontally extending array of crypts.

The crypt structure of U.S. Pat. No. 3,897,663 has spaced parallel vertical walls having sidewardly projecting supports at vertically spaced locations, horizontal slabs being positioned on the support so as to extend between the side walls. The arrangements of U.S. Pat. Nos. 3,878,656, and 3,938,773 employ modules which have at least portions which are of inverted U shaped section so that the lower edges of these may rest upon upper walls of underlying modules to form the structure. The arrangements in U.S. Pat. Nos. 4,048,772 and 5,243,794 use L-shaped modules. All of these arrangements are therefore characterised in that each module defines less than the whole of the side wall/ceiling/floor of each individual crypt. That is, in each case one horizontal slab or an analogous modular portion forms both the floor and the ceiling of each vertically adjacent pair of crypts, and each crypt chamber is not defined until vertically superimposed modules are provided.

U.S. Pat. No. 2,783,523 describes a burial vault formed of concrete and having a separately formed roof. Two vaults may be stacked one above the other, but this arrangement is not convenient for forming a multi-crypt mausoleum. For example, since access to the lower vault is prevented when the uppermost vault is positioned on it, so the lower vault must be closed before stacking the vaults.

U.S. Pat. No. 1,014,614 describes a temporary burial vault, which has bottom top and side walls moulded together and an end cover slidable vertically to a position where it closes an open end of the vault. This vault is also not suitable for forming a multi-crypt mausoleum.

U.S. Pat. No. 692,067 (Okey) describes a portable burial vault formed of a metal inner shell, closed by an end closure and then sealed by application over all exterior surfaces of a concrete-like material. Because of its configuration, this is not suitable for forming a multi-crypt mausoleum.

It is highly desirable that crypts be properly sealable. Otherwise gases or liquid products formed from the entombed body may leak from the crypt and cause undesirable odours and unsightly appearance, or damage. Infestation by insects can occur if even a slight crack or opening appears in the crypt. On the other hand, it is extremely difficult to secure long term sealing in the described prior constructions. Even where adequate sealing is in the first instance provided, such as by placing sealing material between portions of the structure defining a crypt floor and side walls of the crypt, such as by use of settable or resilient sealing elements, most mausoleum structures are substantial in size and weight, and it is impossible to surely avoid long term movement of modules relative to each other, such as due to settling of mausoleum foundations, or expansion or contraction of modules or parts of these. In cases where the modules are structurally self-sufficient (ic individually capable of self-support) movement as between modules, such as twisting movement about the lengthwise axis of a crypt, may quite readily open up gaps between adjacent modules. This is particularly so where, as is usual, reinforced concrete is the medium from which the modules are formed.

Generally, cracking of concrete structures is likely to occur over time, and will in the prior described constructions likely in any event to lead to leakage in the long term.

SUMMARY OF THE INVENTION

In one aspect, the invention provides a method of forming a mausoleum comprising:

(a) providing a first plurality of crypt structures each in the form of a seamless one piece elongate tubular liner member having integral opposed side walls, a floor and a roof and outstanding rib members on the exterior thereof at locations adjacent the opposite ends thereof said rib members extending substantially around the peripheries of the liner members at said locations, (b) disposing ones of the first plurality of crypt structures in a side by side assembly on a base such that the undersides of the floors of the liner members are spaced, by ones of the rib members at the undersides of the liner members, in spaced relationship above the base, and such that adjacent side walls of the or each adjacent pair of liner members are disposed in spaced relationship, the rib members at the upper surfaces of the liner members providing trowelling surfaces extending across the assembly at a predetermined height above the roofs of the crypt structures, spaces defined between the base and the floors of the crypt structures communicating with the or each space between crypt structures of the or each said adjacent pair, and each said space being at least partly closed at ends thereof by ones of said ribs (c) disposing upright end wall members one to either side of said assembly so as to substantially engage ones of the rib members at the sides of outermost ones of the crypt structures of said assembly, at locations adjacent the ends of those crypt structures, so as to define spaces between the end wall members and the side walls of the outermost crypt structures, these spaces being at least partly closed at each end thereof by ones of said ribs (d) applying flowable settable material into said spaces so as to substantially surround each said crypt structure at the side walls roofs and floors thereof, (e) setting or allowing to set the flowable and settable material so as to form an integral support structure in which the crypt structures are embedded, said support structure having a floor section disposed under the crypt structures, upstanding wall sections at each side of said assembly and between the or each said adjacent pair of crypt structures, and a roof section over the crypt structures.

The method may include the further steps of:

(f) providing a second plurality of crypt structures each in the form of a seamless one piece elongate tubular liner member having integral opposed side walls, a floor and a roof, and outstanding rib members on the exterior thereof at locations adjacent the opposite ends thereof, said rib members of said second plurality of crypt structures extending substantially around the peripheries of the liner members thereof at said locations, (g) disposing ones of the second plurality of crypt structures in a second side by side assembly on said roof section such that the undersides of the floors of the liner members of said second plurality of crypt structures are spaced, by ones of the rib members thereof at the undersides of those liner members, in spaced relationship above the roof section, and such that adjacent side walls of the or each adjacent pair of liner members of said second plurality of crypt structures are disposed in spaced relationship, the rib members at the upper surfaces of the liner members of said second plurality of crypt structures providing trowelling surfaces extending across the second assembly at a predetermined height above the roofs of the crypt structures of said second plurality of crypt structures, further spaces defined between said roof sections and the floors of the crypt structures of said second plurality of crypt structures communicating with the or each further space between crypt structures of the or each said adjacent pair of said second plurality of crypt structures, said further spaces being at least partly closed at ends thereof by ones of said ribs of said second plurality of crypt structures, and the upright end wall members substantially engaging ones of the rib members at the sides of outermost ones of the crypt structures of said second assembly, at locations adjacent the ends of those crypt structures, so as to define further spaces between the end wall members and the side walls of the outermost crypt structures of said second plurality of crypt structures, these further spaces being at least partly closed at each end thereof by ones of said ribs of the crypt structures of said second plurality of crypt structures.

(h) applying further flowable settable material into said further spaces so as to substantially surround each said crypt structure of said second plurality of crypt structures at the side walls, roofs and floors thereof, (i) setting or allowing to set the further flowable and settable material so as to form a further integral support structure in which the crypt structures of said second plurality of crypt structures are embedded.

In another aspect, the invention provides a method of forming a mausoleum comprising:

(a) providing a first plurality of crypt structures each in the form of a seamless one piece elongate tubular liner member having integral opposed side walls, a floor and a roof and outstanding rib members on the exterior thereof at locations adjacent the opposite ends thereof said rib members extending substantially around the peripheries of the liner members at said locations, (b) disposing ones of the first plurality of crypt structures in a side by side assembly on a base such that the undersides of the floors of the liner members are spaced, by ones of the rib members at the undersides of the liner members, in spaced relationship above the base, and such that adjacent side walls of the or each adjacent pair of liner members are disposed in spaced relationship, spaces defined between the base and the floors of the crypt structures communicating with the or each space between crypt structures of the or each said adjacent pair, (c) disposing upright end wall members one to either side of said assembly so as to substantially engage ones of the rib members at the sides of outermost ones of the crypt structures of said assembly, at locations adjacent the ends of those crypt structures, so as to define spaces between the end wall members and the side walls of the outermost crypt structures, (d) applying flowable settable material into said spaces so as to substantially surround each said crypt structure at the side walls roofs and floors thereof, (e) setting or allowing to set the flowable and settable material so as to form an integral support structure in which the crypt structures are embedded, said support structure having a floor section disposed under the crypt structures, upstanding wall sections at each side of said assembly and between the or each said adjacent pair of crypt structures, and a roof section over the crypt structures.

The last described method may include the further steps of:

(f) providing a second plurality of crypt structures each in the form of a seamless one piece elongate tubular liner member having integral opposed side walls, a floor and a roof, and outstanding rib members on the exterior thereof at locations adjacent the opposite ends thereof, said rib members of said second plurality of crypt structures extending substantially around the peripheries of the liner members thereof at said locations, (g) disposing ones of the second plurality of crypt structures in a second side by side assembly on said roof section such that the undersides of the floors of the liner members of said second plurality of crypt structures are spaced, by ones of the rib members thereof at the undersides of those liner members, in spaced relationship above the roof section and such that adjacent side walls of the or each adjacent pair of liner members of said second plurality of crypt structures are disposed in spaced relationship, further spaces defined between said roof sections and the floors of the crypt structures of said second plurality of crypt structures communicating with the or each further space between crypt structures of the or each said adjacent pair of said second plurality of crypt structures, and the upright end wall members substantially engaging ones of the rib members at the sides of outermost ones of the crypt structures of said second assembly, at locations adjacent the ends of those crypt structures, so as to define further spaces between the end wall members and the side walls of the outermost crypt structures of said second plurality of crypt structures, (h) applying further flowable settable material into said further spaces so as to substantially surround each said crypt structure of said second plurality of crypt structures at the side walls, roofs and floors thereof, (i) setting or allowing to set the further flowable and settable material so as to form a further integral support structure in which the crypt structures of said second plurality of crypt structures are embedded.

The flowable settable material may be cementitious, in the form of concrete for example.

Where the method comprises the step of providing the second plurality of crypt structures, these may be disposed with at least some of the rib members thereof on underlying rib members of ones of the first plurality of crypt structures.

The liner members arc preferably formed of plastics material.

The methods of the invention may further comprise the step of applying and sealing end closures to at least one ends of the liners, such as before said applying flowable settable material.

The crypt structure liner members may have ribs at locations between the opposite ends thereof. The invention also provides a mausoleum formed by a method according to the invention, and a crypt structure for use in that method.

The invention also provides a mausoleum formed from a plurality of crypt structures each having a generally tubular plastics crypt liners surrounded at side, roof and floor portions thereof by set flowable settable material, such as concrete.

The invention also provides a method of forming a mausoleum comprising embedding in flowable settable material a plurality of crypt structures each having a generally tubular plastics crypt liner such that the liners are surrounded at side, roof and floor portions thereof by said flowable settable material.

Preferably, opposite ends of the crypt liners are not surrounded by said flowable settable material.

BRIEF DESCRIPTION OF THE SEVERAL VIEWS OF THE ACCOMPANYING DRAWINGS

The invention is further described by way of example only with reference to the accompanying drawings in which:

FIG. 3 is a plan view of the crypt structure of FIG. 2;

FIG. 5 is a front view of a closure forming part of the crypt structure of FIG. 2;

FIG. 6 is a side view of the lid of FIG. 5;

FIG. 7 is a fragmentary vertical cross-section of one end of the crypt structure of FIG. 2 and illustrating the manner of fitting of the closure thereon;

Figure 1:
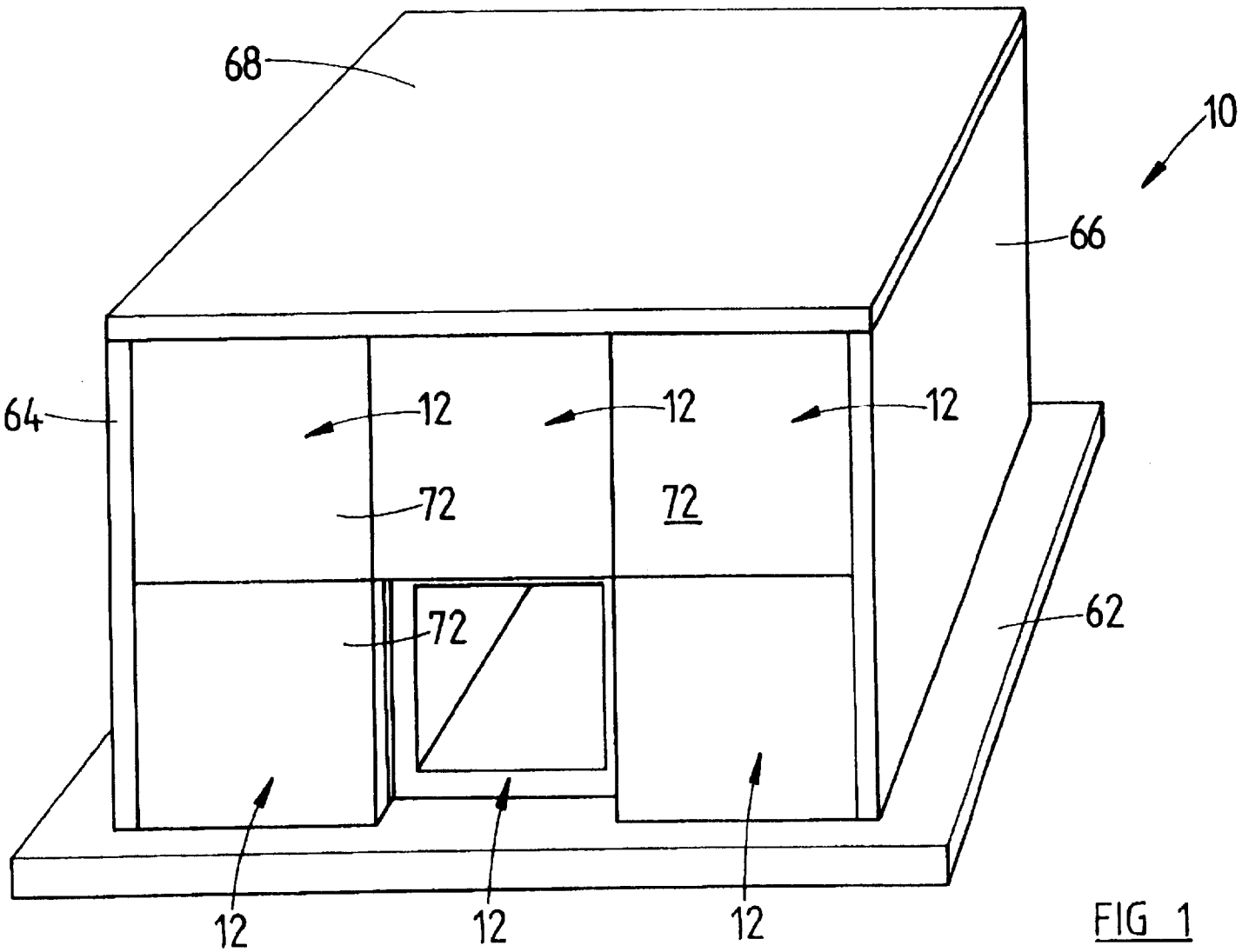
FIG. 1 is a diagrammatic perspective view of a mausoleum constructed in accordance with the invention, one of a number of crypt closures in the mausoleum being shown demounted.

Referring to FIG. 1, the mausoleum 10 shown therein comprises a two-dimensional array of crypt structures 12 positioned in sidewardly extending rows stacked one above the other, with crypt structures 12 in each row being vertically aligned. The mausoleum is erected on a flat base 62 formed for example of granite, concrete or the like, upright side wall members 64,66, and a roof member 68, which side wall members and roof members may also be of concrete granite or the like.

The crypt structures 12 are each formed from the components shown in FIGS. 2 to 6. In particular, each structure includes an elongate seamlessly formed somewhat tubular liner 14 having opposed side walls 30, a floor 20 and a roof 32. Each liner 14 may be formed as a single plastics moulding, such as by rotational moulding.

Each liner 14 is of generally rectangular transverse section, defining a hollow interior space 52. This space is open at each end of the liner.

Each liner 14 has three peripherally extending rib formations 50, one at either end, and one intermediate the two ends. Each of the rib formations is comprised of four outstanding ribs 50*a*,50*b*,50*c*,50*d* respectively disposed on the roof, respective side walls, and, the floor of the liner. The rib formations may for example be wholly or partly integrally formed during the moulding process and possibly reinforced,by suitable reinforcing material. In the construction shown they are formed partly by outturned lips or edges on the liners 14 and partly from rectangular lengths 57 of metal section or wood (FIG. 7). The ribs 50*a* through 50*d* are each linear, with ribs 50*a* and 50*b* being parallel and ribs 50*d* and 50*c* being parallel, in each rib formation 50. As shown, the ribs in each form, in this case, a continuous rectangular frame around the periphery of the liner 14. The ribs extend a short distance outwardly from the periphery of the remainders of the liners 14.

The opposite ends of the liner 14 are closable by covers 18 as shown in FIGS. 5. 6 and 7. These are in the form of rectangular plastics mouldings having a rectangular inner portion 18*a* with a rectangular peripheral flange 18*b* therearound, the flange 18*b* adjoining the portion 18*a* at the periphery thereof, as viewed in FIG. 7, and extending substantially normally from the periphery for a short distance and then extending outwardly in some what parallel disposition to the portion 18*a*. Portion 18*a* is designed to fit into either end of the liner 14 with the flange 18b then resting against an out-turned peripheral flange 54 on the liner, there being two such flanges one at either end of the liner adjacent the end rib structures. The covers 18 may have rectangular granite or other exterior decorative material affixed thereto, such as the rectangular slabs 72 shown in FIG. 1.

The liners are provided with suitable reinforcing formations 70 which may be integrally moulded therewith.

Figure 8:
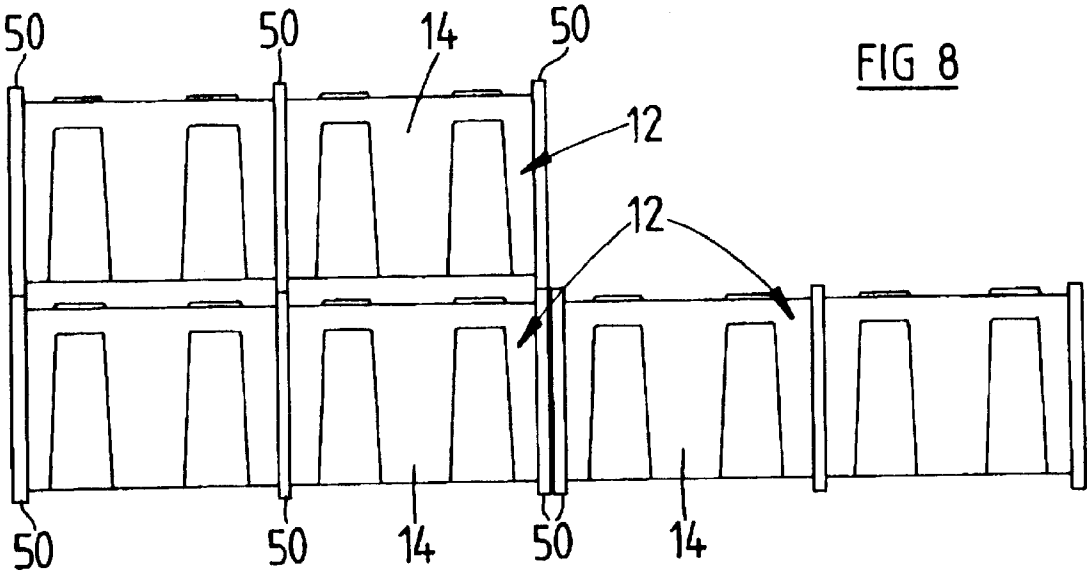
FIG. 8 is a side view of a stacked assembly of crypt structures, as may be incorporated into the mausoleum of FIG. 1.
Figure 2:
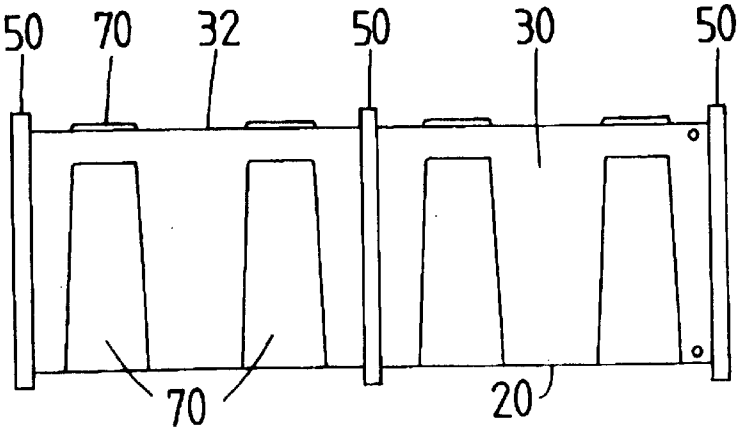
FIG. 2 is a side view of one of a number of like crypt structures incorporated into the mausoleum of FIG. 1.
Figure 4:
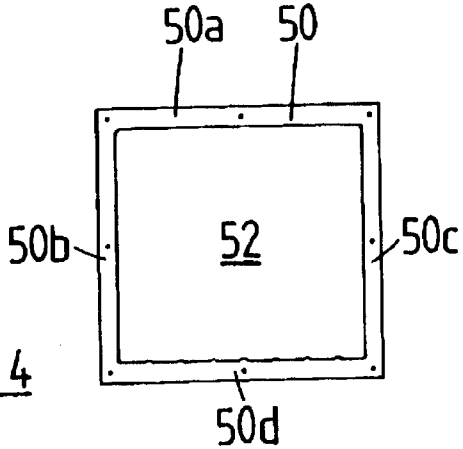
FIG. 4 is a front view of the crypt structure of FIG. 2.

As shown in FIG. 8, and illustrated in more detail hereinafter, it is possible stack crypt structures, or the liners 14 thereof, one above the other and in side-by-side disposition. FIG. 8 shows two liners 14 one positioned above the other, with the rib structures 50 of the uppermost one resting upon the rib structures 50 of the lowermost one. It is also possible to join multiple liners together end to end so that the crypt structure is made longer. The lower two liners 14 are shown so joined in FIG. 8 by a suitable joining and sealing as between adjacent ends thereof at the flanges 54.

Figure 9:
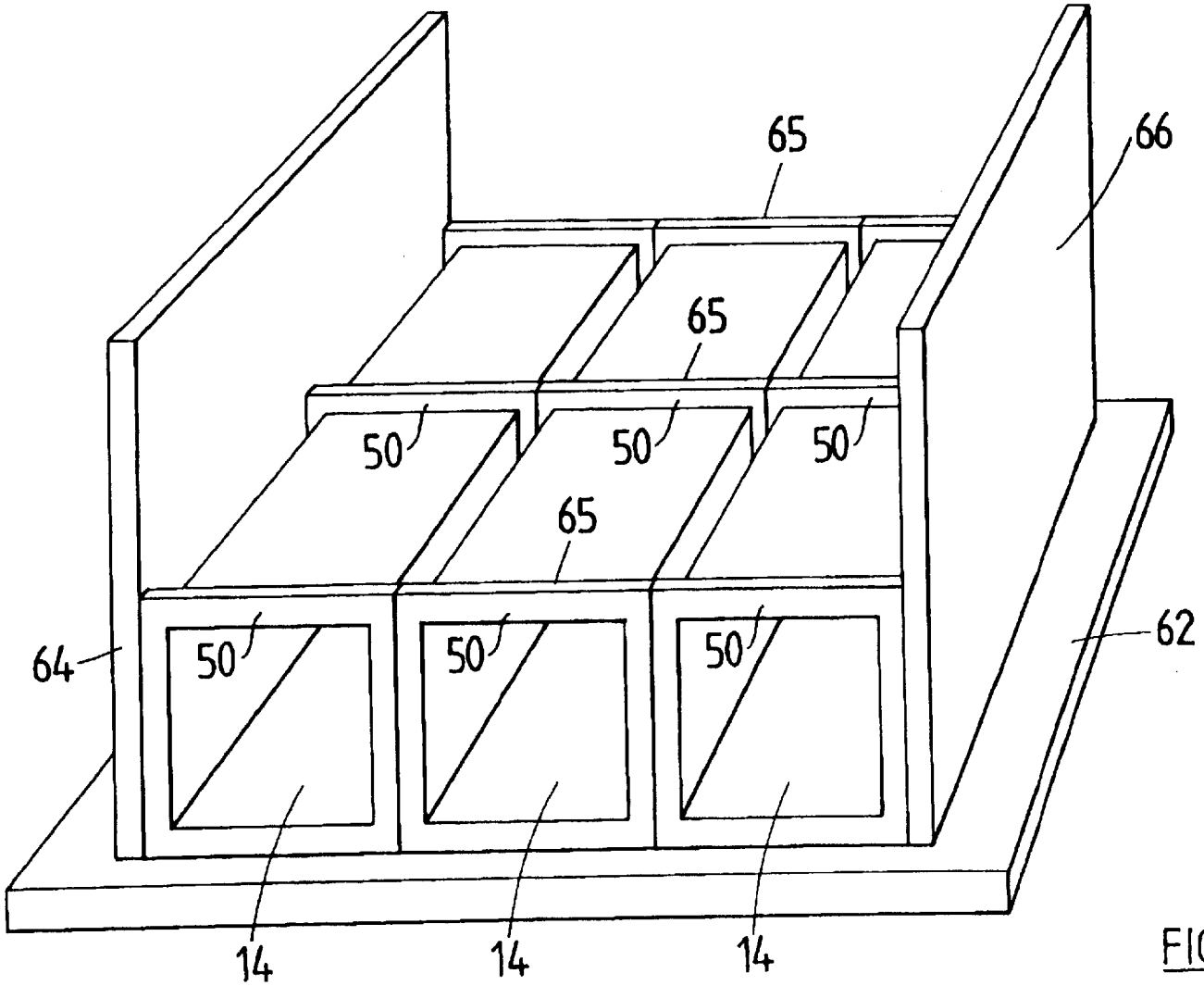
FIG. 9 is a perspective view illustrating a step in the formation of the mausoleum of FIG. 1.
Figure 10:
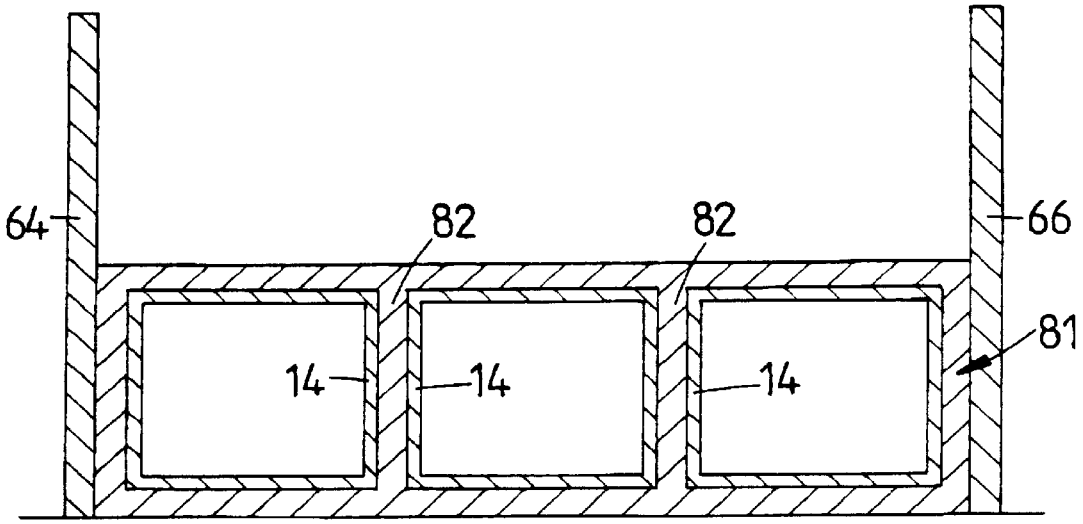
FIGS. 10 and 11 are transverse cross-sections illustrating further steps in the formation of the mausoleum of FIG. 1.
Figure 11:
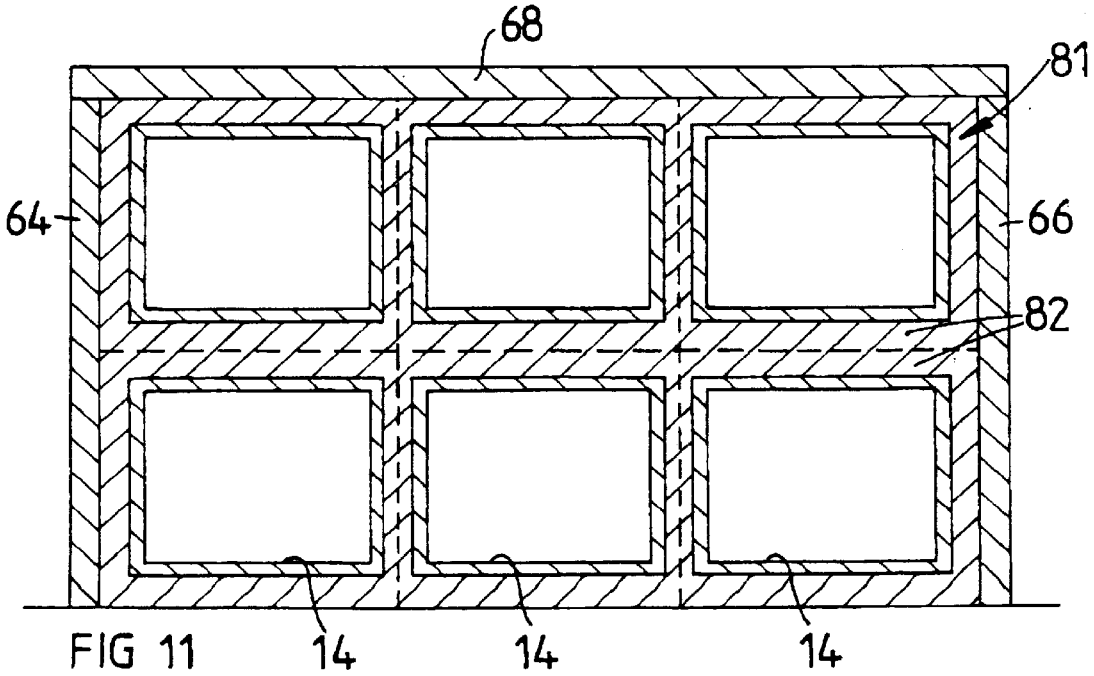

FIGS. 9 to 11 illustrate in more detail the manner of formation of the mausoleum 10 using the described structures. First, as shown in FIG. 9, the base 62 is formed on the ground and a plurality of the liners 14 laid side-by-side thereon in aligned relationship such that side edges of the flanges 50*a*,50*c*, at each of the three locations along the length of each are in touch and transversely aligned with the rib structures 50*c*,50*a* of the adjacent liner or liners 14. The opposed side wall members 64,66 are positioned at the other sides of the assembly comprised of the side-by-side liners 14, so as to engage the side edges of the ribs of the outermost ones of the liners. In this fashion, the upper edges of the ribs 50*a* of the side-by-side liners define more-or-less continuous side-to-side linear trowelling surfaces 65. Furthermore, by virtue of the presence of the ribs 50*d* at the undersides of the floors of the liners, there is a more-or-less continuous space extending side-to-side of the assembly, between the base 62 and the undersides of the floors of the liners. These spaces are interrupted in this case only by the barrier presented by the rib portions of central rib structures 50.

There are further spaces 78 between the adjacent pairs of liners 14, these extending vertically and communicating with the spaces to the undersides of the liners. Also at each opposite side, there are spaces between the outer side walls of the outermost liners 14 and the upright side wall members 64,66. These spaces likewise communicate with the spaces to the underside of the liners.

Subsequent to arranging the liners 14 in the fashion shown in FIG. 9, settable concrete is poured over these and into the spaces between the liners and base and side walls of the mausoleum so as to surround the liners. Where this concrete is positioned above the roofs of the Liners, it is trowelled off in a suitable fashion using, say, an elongate trowelling member which is at least as long as the liners and which is moved from side-to-side over the trowelling surfaces 65.

When the concrete has set, the liners 14 are embedded in the concrete 81, which forms a continuous support structure 80 around the periphery of each liner (FIG. 10). A roof section 82 of this structure is, by virtue of the described trowelling off, generally planar and, in a subsequent step, further liners 14 are laid upon this in a similar fashion to the liners 14 shown in FIG. 9 and further concrete poured and trowelled off to produce a second layer of the crypt structure (FIG. 11). This procedure may be repeated to produce a mausoleum of any desired height, but in the present instance the assembly is completed at this point by placing the roof member 64 over the top of the second layer.

In use, once the mausoleum has been formed in the way described, human remains may be placed in the spaces 52, and the crypt structures closed by fixing of the covers 18. Suitable sealing arrangements may be made in that connection in order to ensure that the covers are securely assembled in a leak-proof fashion.

Figure 12:
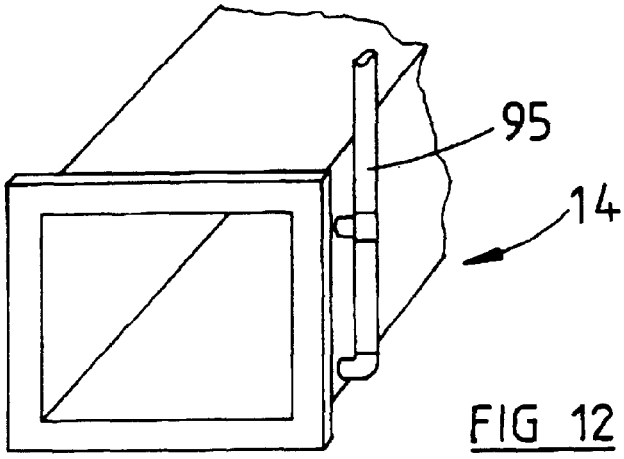
FIG. 12 is a fragmentary perspective view of the modified constructions of a mausoleum in accordance with the invention.
Figure 13:
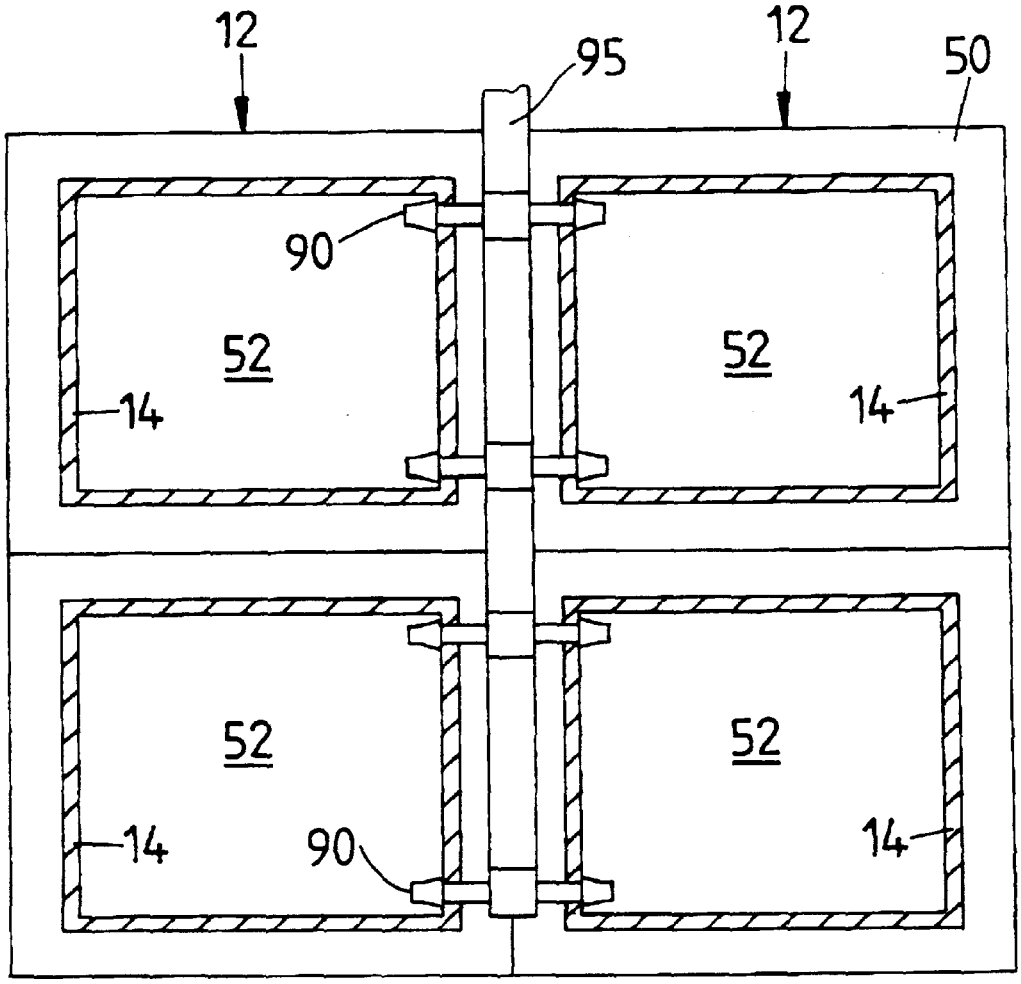
FIG. 13 is a fragmentary cross-sectional view of the modified construction of a mausoleum in accordance with FIG. 12.

In order to provide for egress of gases or other products from the crypt structures, suitable vertically extending pipes 95 may be arranged as shown in FIG. 12 and 13 so as to communicate with fittings 90 in the side walls of the liners 14. It is a simple matter to position these prior to concreting as each layer of liners 14 is progressed during construction.

Figure 14:
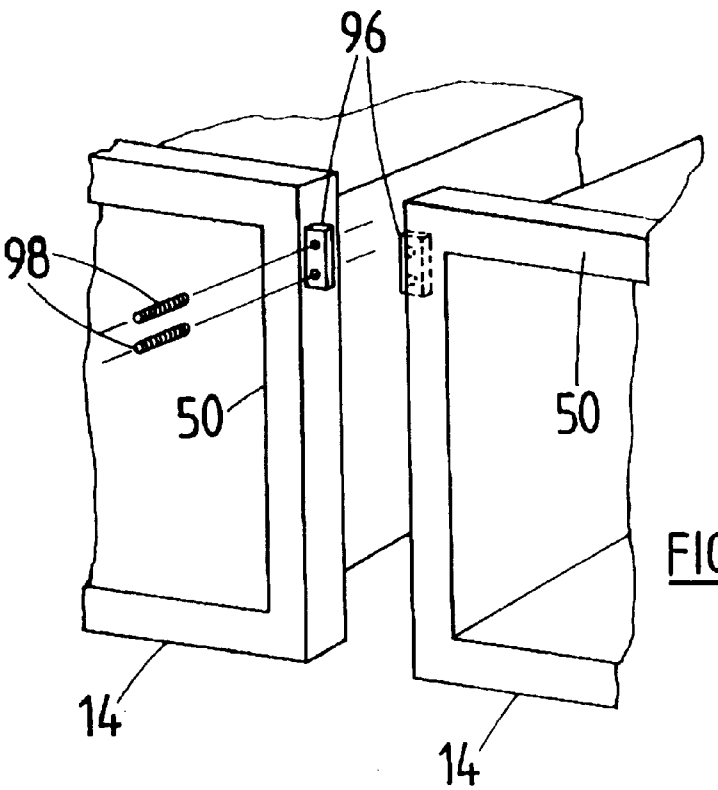
FIG. 14 is a fragmentary perspective view showing an optional interconnection means useful in the invention.
Figure 15:
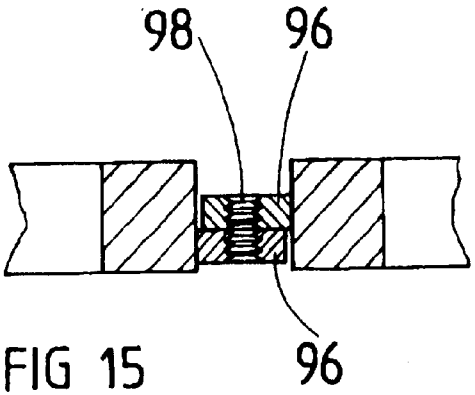
FIG. 15 is a fragmentary horizontal section showing the optional interconnection means of FIG. 14.

Also, as shown in FIGS. 14 and 15, means may be provided at, for example, each end of the liners 14 for affixing these in side by side relationship so as facilitate the location of these during practising of the method of the invention. Thus, FIG. 14 shows outwardly extending flanges to secured as by welding to the rib structures 50 of two adjacent liners 14. These flanges are so disposed that when the liners 14 are positioned side by side as shown in FIG. 15, the flange 96 on one liner 14 is positioned immediately in front of the flange on the other liner 14 and with threaded openings in the flanges aligned so that threaded elements 98, such as bolts or the like, can be screwed into these aligned openings to secure the flanges together and thus hold the liners 14 structures in spaced disposition. Of course, a number of these flanges 96 may be provided around the peripheries of some or all of the structures 50.

In the arrangement shown in FIGS. 14 and 15, because the side edges of the rib structures 50 do not abut completely against each other, but are somewhat spaced apart as shown, steps would usually need to be taken when practising the method to ensure that the concrete does not exude through the spaces between the adjacent rib structures when it is poured between the crypt structures. This may simply be accomplished by provision of suitable packing material such as wooden pieces between the liners 14, which material may for example, be subsequently removed.

The plastics material from which the liners are formed may comprise polyethylene.

Figure 16:
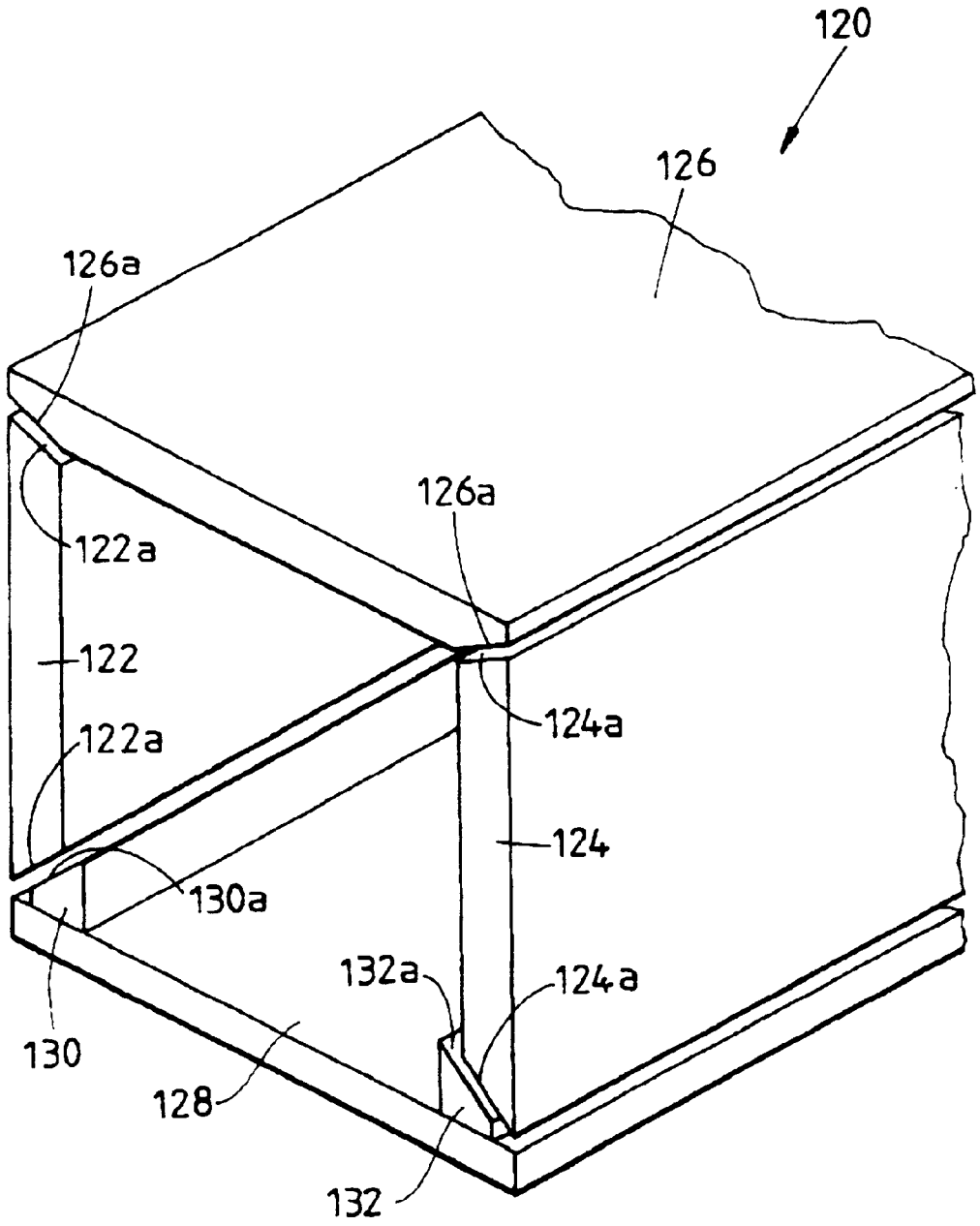
FIG. 16 is a fragmentary perspective view of a reinforcing structure useful in practising the invention.
Figure 17:
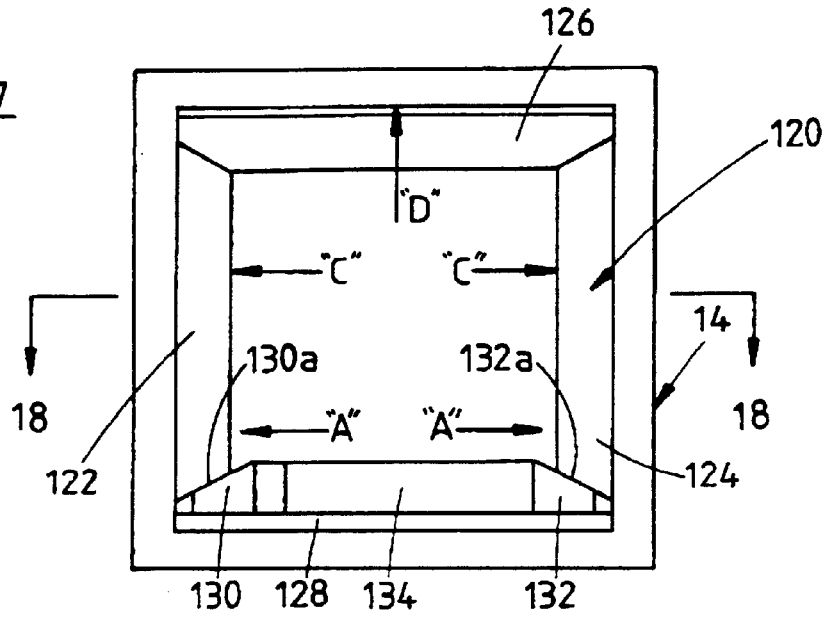
FIG. 17 is an end view of a crypt structure of the invention, fitted with the reinforcing structure of FIG. 16.
Figure 18:
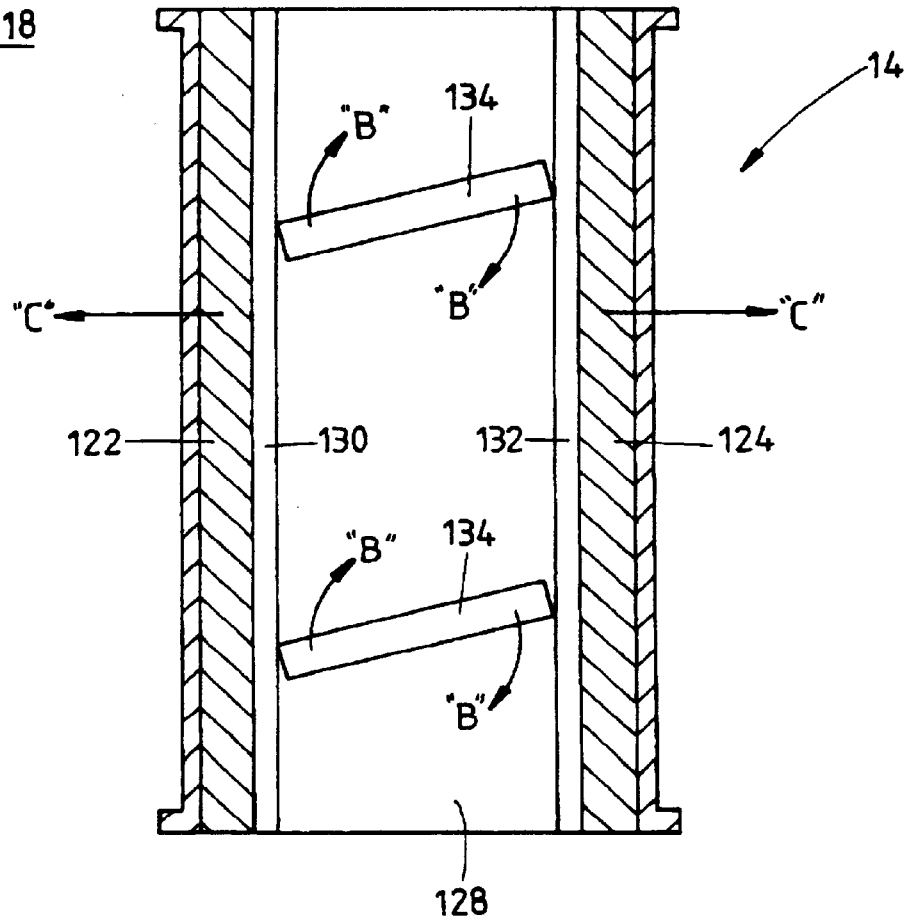
FIG. 18 is a cross-section on the line 18—18 in FIG. 17, illustrating a step in positioning elements of the reinforcing structure of FIG. 16.

In the crypt structure as described, the liners 14 do not, in the finished structure, need to be of great structural strength, since the set concrete provides the necessary strength for the structure. It is thus, in principle, possible that the wall thickness of the liner could be quite small. That is, thin walled liners, having a wall thickness of for example in the range 3 to 10 mm. such as 6 mm, may be employed. On the other hand, if relatively thin wall thicknesses are employed, there is some risk that the pressure of concrete poured around the liners will, during and after the pouring process, inwardly distort the side walls, floor and roof of the liners. Thus, while the employment of relatively thin liners is otherwise satisfactory, and would be desirable in the interests of economy of manufacture, unwanted distortion of the liner may occur in such cases unless special steps are taken to prevent this. In the described arrangements, the provision of the intermediate rib formation 50, between the ends of the liners, and the provision of the reinforcing formations 70 assist in resisting deformation during pouring of the concrete. However, if very thin walls are employed, these measures may not be sufficient to ensure that the shape of the liners is adequately maintained. In such cases, suitable reinforcing structure may be inserted into the liners before pouring. Conveniently, this may be demountable so as to permit ready positioning in the liners prior to pouring and ready removal thereafter when the concrete is set or at least sufficiently set as to avoid deformation action against the liners. FIGS. 16 to 18 illustrate a suitable reinforcing structure.

The reinforcing structure 120 shown in FIGS. 16 to 18 is a somewhat tubular demountable structure formed of rigid generally planar side panels 122, 124, a generally planar roof 126 and a generally planar floor 128. Lengthwise extending edges 126*a* of roof 126 are bevelled at a suitable angle such as 45°, as are lengthwise extending edges 122*a*. 124*a* of the side walls 122, 124.

The structure 120 is laid into the Liner 14 in the fashion shown in FIG. 17, that is to say with the planar floor 128 positioned on the floor of the liner, the floor 128 being of width substantially equal to the width of the floor of the liner. Two lengthwise extending wedge members 130, 132 are then positioned on the floor 128. These are in the form for example, of lengths of timber, having a somewhat trapezoidal cross-section, particularly including a base surfaces which rest on the floor 128 and opposed upper angled surfaces 130*a*, 132*a* as shown. These members are positioned one to either side of the liner on the floor 128 adjacent respective side walls of the liner 14, and with the surfaces 130*a*, 132*a* angled so that lower edges of these are outermost. The side walls 122, 124 of the reinforcing structure 120 are then positioned against inner surfaces of the side walls of the liner 14, with angled lower side edges 122*a*, 124*a* resting on and generally aligned with respective ones of the surfaces 130*a*, 132*a* of the members 130, 132. Then, the roof 126 of the reinforcing structure is slid into position so that the upper surface thereof is adjacent the inner surface of the roof of the liner 14 and the side edges 126*a* bear against and are generally parallel to respective ones of the edges 122*a*, 124*a* on side walls 122, 124. This assembly 120 may be made relatively roughly, with the floor, side walls and roof of the reinforcing structure loosely in position. Then, the members 130, 132 are pushed towards the respective adjacent side walls of the liner 14, that is to say pushed in the direction indicated by the arrows "A" in FIG. 17. This may be effected simply by use of elongate camming pieces 134 formed for example of suitably sized lengths of timber. These are rested on the floor 128 and rotated in directions indicated by the arrows "B" in FIG. 18 so that ends thereof bear against the inner sides of the members 130, 132. It is thus possible, by for example hammering the pieces 134, to exert a very strong wedging force against the members 130, 132 to press the side walls 122, 124 outwardly in directions shown for example by arrow "C" in FIG. 17 and FIG. 18 while at the same time, by virtue of the camming engagement between the touching edges of the side walls 122, 124 and of the roof 126, to press the side walls 122, 124 and the roof 126 upwardly as indicated by the arrow "D" in FIG. 17.

By the described method, it is possible to cause the reinforcing structure to assume a quite rigid state at which the planar outer surfaces of the floor, roof and side walls of the structure are pressed into intimate engagement with the inner surfaces of the roof, floor and side walls of the liner 14. In this state, when concrete is poured around the liner, the reinforcing structure resists deformation of the wall structure under weight of the concrete. The structure 120 is then removed, subsequent to setting of the concrete. The latter may be effected simply by prising out the members 130, 132 in directions opposite to those indicated by the arrows "A".

In practice, if a crypt is assembled layer by layer, it is sufficient to provide only enough reinforcing structures 120 for each layer.

It has been found that, by the use of the reinforcing structures 120, it may be possible to dispense with the intermediate rib formations 50 on the crypt structures, and in any event to make these of less structural strength than would otherwise be necessary. For example, the rectangular lengths 57 shown in FIG. 7 may be omitted.

Whilst the described liners 14 are of rectangular transverse section, of course they may be made in any suitable form, such as square, circular or the like.

In the described arrangement, the mausoleum is erected layer by layer. It would, of course, be possible to first erect two or more layers of crypt structures and then pour the concrete. It has been found, however, that it is easier to ensure adequate filling of the spaces between the crypt structures, if the mausoleum is erected layer by layer as described.

The concrete material 81 may be suitably reinforced such as by use of vertical or other steel rod embedded therewithin.

The described arrangement has been advanced merely by way of explanation and many modifications may be made thereto without departing from the spirit and scope of the invention as defined in appended claims.

I claim:

1. A method of forming a mausoleum comprising:

(a) providing a first plurality of crypt structures each in the form of a seamless one piece elongate tubular liner member having integral opposed side walls, a floor and a roof, and outstanding rib members on the exterior thereof at locations adjacent the opposite ends thereof, said rib members extending substantially around the peripheries of the liner members at said locations, (b) disposing ones of the first plurality of crypt structures in a side by side assembly on a base such that the undersides of the floors of the liner members are spaced, by ones of the rib members at the undersides of the liner members, in spaced relationship above the base, and such that adjacent side walls of the or each adjacent pair of liner members are disposed in spaced relationship, the rib members at the upper surfaces of the liner members providing trowelling surfaces extending across the assembly at a predetermined height above the roofs of the crypt structures, spaces defined between the base and the floors of the crypt structures communicating with the or each space between crypt structures of the or each said adjacent pair, and each said space being at least partly closed at ends thereof by ones of said ribs, (c) disposing upright end wall members one to either side of said assembly so as to substantially engage ones of the rib members at the sides of outermost ones of the crypt structures of said assembly, at locations adjacent the ends of those crypt structures, so as to define spaces between the end wall members and the side walls of the outermost crypt structures, these spaces being at least partly closed at each end thereof by ones of said ribs, (d) applying flowable settable material into said spaces so as to substantially surround each said crypt structure at the side walls roofs and floors thereof, (e) setting or allowing to set the flowable and settable material so as to form an integral support structure in which the crypt structures are embedded, said support structure having a floor section disposed under the crypt structures, upstanding wall sections at each side of said assembly and between the or each said adjacent pair of crypt structures, and a roof section over the crypt structures.

2. A method as claimed in claim 1, including the further steps of:

(f) providing a second plurality of crypt structures each in the form of a scamless one piece elongate tubular liner member having integral opposed side walls, a floor and a roof, and outstanding rib members on the exterior thereof at locations adjacent the opposite ends thereof said rib members of said second plurality of crypt structures extending substantially around the peripheries of the liner members thereof at said locations, (g) disposing ones of the second plurality of crypt structures in a second side by side assembly on said roof section such that the undersides of the floors of the liner members of said second plurality of crypt structures are spaced, by ones of the rib members thereof at the undersides of those liner members, in spaced relationship above the roof section, and such that adjacent side wails of the or each adjacent pair of liner members of said second plurality of crypt structures are disposed in spaced relationship, the rib members at the upper surfaces of the liner members of said second plurality of crypt structures providing trowelling surfaces extending across the second assembly at a predetermined height above the roofs of the crypt structures of said second plurality of crypt structures, further spaces defined between said roof sections and the floors of the crypt structures of said second plurality of crypt structures communicating with the or each further space between crypt structures of the or each said adjacent pair of said second plurality of crypt structures, said further spaces being at least partly closed at ends thereof by ones of said ribs of said second plurality of crypt structures, and the upright end wall members substantially engaging ones of the rib members at the sides of outermost ones of the crypt structures of said second assembly, at locations adjacent the ends of those crypt structures, so as to define further spaces between the end wall members and the side walls of the outermost crypt structures of said second plurality of crypt structures, these further spaces being at least partly closed at each end thereof by ones of said ribs of the crypt structures of said second plurality of crypt structures, (h) applying further flowable settable material into said further spaces so as to substantially surround each said crypt structure of said second plurality of crypt structures at the side walls, roofs and floors thereof, (i) setting or allowing to set the further flowable and settable material so as to form a further integral support structure in which the crypt structures of said second plurality of crypt structures are embedded.

3. A method as claimed in claim 2 wherein the second plurality of crypt structures are disposed with at least some of the rib members thereof on underlying rib members of ones of the first plurality of crypt structures.

4. A method as claimed in claim 1, 2 or 3 wherein the flowable settable material comprises cementitious material.

5. A method as claimed in claim 1, 2 or 3, wherein the liner members are formed of plastics material.

6. A method as claimed in claim 1, further comprising the step of applying and sealing end closures to at least one end of the liners.

7. A method as claimed in claim 1, 2 or 3, wherein the liner members have ribs at locations between the opposite ends thereof.

8. A method as claimed in claim 1 including the step of, prior to said applying flowable settable material, applying to the interior of the liner members a reinforcing frame to inhibit deformation of the liners when said flowable settable material is applied.

9. A method as claimed in claim 8 including the step of removing said reinforcing frame when said flowable settable material is at least substantially set.

10. A mausoleum formed by the method as claimed in claim 1, 2 or 3.

11. A method as claimed in claim 1, 2 or 3, wherein the liner members have ribs at locations between the opposite ends thereof.

12. A method as claimed in claim 7, wherein said step of applying and sealing end closures to at least one of the liners is effected before said applying flowable settable material.

13. A method as claimed in claim 1, 2 or 3, wherein the flowable settable material comprises cementitious material and the liner members are formed of plastics material.

14. A method of forming a mausoleum comprising:

(a) providing a first plurality of crypt structures each in the form of a seamless one piece elongate tubular liner member having integral opposed side walls, a floor and a roof, and outstanding rib members on the exterior thereof at locations adjacent the opposite ends thereof, said rib members extending substantially around the peripheries of the liner members at said locations, (b) disposing ones of the first plurality of crypt structures in a side by side assembly on a base such that the undersides of the floors of the liner members are spaced, by ones of the rib members at the undersides of the liner members, in spaced relationship above the base, and such that adjacent side walls of the or each adjacent pair of liner members are disposed in spaced relationship, spaces defined between the base and the floors of the crypt structures communicating with the or each space between crypt structures of the or each said adjacent pair, (c) disposing upright end wall members one to either side of said assembly so as to substantially engage ones of the rib members at the sides of outermost ones of the crypt structures of said assembly, at locations adjacent the ends of those crypt structures, so as to define spaces between the end wall members and the side walls of the outermost crypt structures, (d) applying flowable settable material into said spaces so as to substantially surround each said crypt structure at the side walls roofs and floors thereof, (e) setting or allowing to set the flowable and settable material so as to form an integral support structure in which the crypt structures are embedded, said support structure having a floor section disposed under the crypt structures, upstanding wall sections at each side of said assembly and between the or each said adjacent pair of crypt structures, and a roof section over the crypt structures.

15. A method as claimed in claim 14 further comprising the steps of:

(f) providing a second plurality of crypt structures each in the form of a seamless one piece elongate tubular liner member having integral opposed side walls, a floor and a roof, and outstanding rib members on the exterior thereof at locations adjacent the opposite ends thereof, said rib members of said second plurality of crypt structures extending substantially around the peripheries of the liner members thereof at said locations, (g) disposing ones of the second plurality of crypt structures in a second side by side assembly on said roof section such that the undersides of the floors of the liner members of said second plurality of crypt structures are spaced, by ones of the rib members thereof at the undersides of those liner members, in spaced relationship above the roof section, and such that adjacent side walls of the or each adjacent pair of liner members of said second plurality of crypt structures are disposed in spaced relationship, further spaces defined between said roof sections and the floors of the crypt structures of said second plurality of crypt structures communicating with the or each further space between crypt structures of the or each said adjacent pair of said second plurality of crypt structures, and the upright end wall members substantially engaging ones of the rib members at the sides of outermost ones of the crypt structures of said second assembly, at locations adjacent the ends of those crypt structures, so as to define further spaces between the end wall members and the side walls of the outermost crypt structures of said second plurality of crypt structures, (h) applying further flowable settable material into said further spaces so as to substantially surround each said crypt structure of said second plurality of crypt structures at the sidewalls, roofs and floors thereof, (i) setting or allowing to set the further flowable and settable material so as to form a further integral support structure in which the crypt structures of said second plurality of crypt structures are embedded.

16. A method as claimed in claim 15 wherein the second plurality of crypt structures are disposed with at least some of the rib members thereof on underlying rib members of ones of the first plurality of crypt structures.

17. A method as claimed in claim 14, claim 15 or 16 wherein the flowable settable material comprises cementitious material.

18. A method as claimed in claim 14, 15 or 16, wherein the liner members are formed of plastics material.

19. A method as claimed in claim 14, 15 or 16, further comprising the step of applying and sealing end closures to at least one end of the liners.

20. A method as claimed in claim 14 including the step of, prior to said applying flowable settable material, applying to the interior of the liner members a reinforcing frame to inhibit deformation of the liners when said flowable settable material is applied.

21. A method as claimed in claim 20 including the step of removing said reinforcing frame when said flowable settable material is at least substantially set.

22. A mausoleum formed by the method as claimed in claim 14, 15 or 16.

23. A method as claimed in claim 19, wherein said step of applying and sealing end closures to at least one of the liners is effected before said applying flowable settable material.

24. A method as claimed in claim 14, 15 or 16, wherein the flowable settable material comprises cementitious material and the liner members are formed of plastics material.

* * * * *